US011808118B2

(12) United States Patent
Skåland

(10) Patent No.: US 11,808,118 B2
(45) Date of Patent: Nov. 7, 2023

(54) APPARATUS FOR, AND METHOD OF, CONTROLLING SAND PRODUCTION FROM AN OIL WELL

(71) Applicant: FourPhase AS, Os (NO)

(72) Inventor: Aksel Skåland, Os (NO)

(73) Assignee: FourPhasse AS, Os (NO)

( * ) Notice: Subject to any disclaimer, the term of this patent is extended or adjusted under 35 U.S.C. 154(b) by 0 days.

(21) Appl. No.: 17/911,791

(22) PCT Filed: May 26, 2021

(86) PCT No.: PCT/EP2021/064003
§ 371 (c)(1),
(2) Date: Sep. 15, 2022

(87) PCT Pub. No.: WO2021/239791
PCT Pub. Date: Dec. 2, 2021

(65) Prior Publication Data

US 2023/0175362 A1 Jun. 8, 2023

(30) Foreign Application Priority Data

May 28, 2020 (GB) ..... 2007998

(51) Int. Cl.
*E21B 43/12* (2006.01)
*E21B 43/34* (2006.01)

(52) U.S. Cl.
CPC ..... *E21B 43/12* (2013.01); *E21B 43/35* (2020.05)

(58) Field of Classification Search
CPC ..... E21B 34/025; E21B 43/12; E21B 43/34; E21B 43/35; G05D 7/0605; G05D 7/0611;
(Continued)

(56) References Cited

U.S. PATENT DOCUMENTS 2,257,244 A * 9/1941 Oehler ..... E21B 43/34 210/187
4,428,841 A * 1/1984 Favret, Jr. ..... B01D 17/0211 210/522
(Continued)

OTHER PUBLICATIONS

Combined Search & Examination Report under Sections 17 and 18(3) in related GB Application 2007998.4 dated Apr. 8, 2021.
(Continued)

*Primary Examiner* — George S Gray
(74) *Attorney, Agent, or Firm* — Polsinelli, P.C.

(57) ABSTRACT

An apparatus and a method for controlling sand production from an oil well. A sand rate comparison value determined at a given oil production rate is used to control the oil production rate by controlling the choke to set the oil production rate to a set production rate corresponding to the oil production rate. The sand rate comparison value is used to confirm that the measured reduced sand flow rate, at that given oil production rate, is below the allowable sand rate (ASR). Since the oil production rate is associated with the sand rate, the sand rate comparison value is used to control the sand rate, by being used to control the oil production rate, and so the sand rate comparison value functions as, and therefore typically comprises, or is, a sand rate control parameter.

17 Claims, 6 Drawing Sheets

(58) Field of Classification Search
CPC ... G05D 7/0617; G05D 7/0623; G05D 7/0635
See application file for complete search history.

(56) References Cited

U.S. PATENT DOCUMENTS

| | | | | |
|---|---|---|---|---|
| 11,435,221 | B1 * | 9/2022 | Metcalf | E21B 21/01 |
| 2008/0154510 | A1 * | 6/2008 | Scott | E21B 43/12 166/250.15 |
| 2019/0033898 | A1 * | 1/2019 | Shah | G01N 29/4427 |
| 2021/0355785 | A1 * | 11/2021 | Ahmari | E21B 41/00 |

OTHER PUBLICATIONS

International Search Report and Written Opinion in related International Application No. PCT/EP2021/064003 dated Jul. 23, 2021.
"Sand Management—The Key to EOR from Mature Fields, Research into Multiple Production Optimization Applications" by Anders Arefjord, et al., Society of Petroleaum Engineers Norway One Day Seminar Apr. 18, 2018, Bergen, Norway.
"Optimizing Usari Field Production Through Effective Sand Management" by O. L. Ishomo et al., Society of Petroleaum Engineers Nigeraia Annual International Conference and Exhibition, Lagos, Nigeria, Aug. 6-8, 2018.
International Preliminary Report on Patentability and Written Opinion of the International Searching Authority in related International Application No. PCT/EP2021/064003 dated Nov. 17, 2022.

* cited by examiner

Figure 1 – Prior Art

Figure 2 – Prior Art

APPARATUS FOR, AND METHOD OF, CONTROLLING SAND PRODUCTION FROM AN OIL WELL

FIELD OF THE INVENTION

The present invention relates to an apparatus for, and method of, controlling sand production from an oil well.

BACKGROUND

Generally the production from an oil well or group of oil wells will comprise oil, gas, water and solid particles (usually sand). In this specification, the term "sand" is used as a collective term and is intended to encompass any solid particles that may be entrained in the oil production flow from an oil well.

Before oil and/or gas can be exported from a production facility to a refinery, transporting by pipeline, or storage facility, it must be first cleaned of any solids and water. Water and solid particles are considered to be by-products that need to be disposed of Usually the solids need to be cleaned of any traces of oil so that they can be disposed of without damage to the environment. Therefore the production flow is best separated into its four phases. Today this often requires a lot of equipment to carry out these separations in sequential steps. In particular, solids are removed first using one processing step followed by water removal and finally gas and oil. As a result, a large footprint or platform area is required which increases the overall cost of the system. This can significantly increase the construction cost of the production facility.

Onshore oil fields are located in many countries around the world. As discussed above, oil wells often produce, as well as the desired oil, and typically also gas, undesired solid particles, usually in the form of sand.

The sand usually requires disposal as a waste by-product of oil production. However, the sand from the oil well is contaminated with oil, for example, and so requires treatment prior to disposal. In various countries there are practical limitations, and also government regulations associated with environmental concerns and policies, that prevent the production of solids/sand from increasing above a certain threshold. As a result, many oil field operators periodically monitor the content of the sand and other phases, e.g. oil & water, of the production hydrocarbon-containing fluid. This monitoring can provide an indication of the volume of sand to be treated for disposal. For example, the monitoring of the content of the hydrocarbon-containing fluid may be carried out once per month.

Such monitoring is most effectively carried out by multiphase flow meters (MFM) which are installed in-line on a production line from an oil well. However, multiphase flow meters are expensive to acquire and install, so it is generally not viable to install a respective multiphase flow meter on each well in an oil field.

Furthermore, such multiphase flow meters currently in commercial use in oil filed installations can only measure the flow of fluid phases, i.e. liquid and gas phases, and cannot measure the flow of a solid phase, for example a sand phase. The sand phase must be separated from the fluid phases and analysed, typically remotely in a laboratory. For example, a sample of the product output along the production line is taken; the sand is separated from the fluid phases; and then the amount (e.g. weight) of sand is measured to determine the flow rate of sand from the respective oil well at that particular point in time.

Therefore, the monitoring exercise requires moving a multiphase flow meter from well to well, recording the phase data for some period of time, and possibly at different production rates, to understand which well(s) are producing the most solids and then possibly choking back particular well(s) to prevent excess sand production. Off-line analysis of the flow rate of the solids must be carried out separately. This can be a very manual and time-consuming process. Furthermore, after the solids have been removed from the oil fraction of the oil well production, the solid particles still have a lot of hydrocarbons stuck to them. The solids are therefore contaminated and require a cleaning treatment. The solids are consequently expensive to dispose of, and usually require to be transported to a dedicated solids clean-up facility at a different location, remote from the oil field and the oil/gas production facility, for treatment. Also, since the transportation may be periodic, and sometimes irregular, large volumes of contaminated solids may have to be collected and stockpiled on-site at the oil/gas production facility, causing potential environmental problems.

For any given oil well, group of interconnected oil wells, or field of oil wells, the challenge for the operator is to achieve the highest possible oil production rate whilst ensuring that the sand production from the oil well, group of oil wells or field of oil wells, does not exceed a maximum threshold that is known in the art of oil production as the Allowable Sand Rate (ASR).

This Allowable Sand Rate is sometimes governed by local regulations, but may also be determined by the operator as the maximum sand production to prevent excess sand reaching the surface that cannot be environmentally handled at the wellsite.

Many operators carry out a practice which defines an ASR value that cannot be exceeded except for a very short period, e.g., a few hours. This level must be set because generally the surface facilities on each well do not have sufficient capacity or ability to cope with treating or storing the additional hydrocarbon-coated sand. The potential erosion of pipelines downstream of the wellhead can also cause costly ongoing maintenance issues. Sand flowing in a pipeline can erode the lining of the pipeline and associated components such as valves.

It is therefore important to note that generally an increase in oil production results in an increase in sand production. There can be many reasons for this: for example, as the reservoir pressure drops the stress state of the reservoir rock increases; the formation takes more of the overburden (formations above the reservoir) weight; the reduced fluid pressure supports less overburden weight; the resulting increase in stress can result in the reservoir formation becoming damaged and thereby produce more sand and/or the increased production flow thereby induces more sand to be brought out of the reservoir and into the well. As a general rule, older oil fields tend to produce more solids in the form of sand. Whatever the reason it is important to ensure that the increased sand production does not stay above the ASR for any significant length of time.

Often oil well performance with respect to oil production against a given required ASR value is evaluated using a periodic, for example, monthly, well test.

It is important to emphasise that, as is known in the art, for any given oil well and at any given time the sand production rate cannot be accurately predicted from the oil production rate, and the oil production rate and the sand production rate do not necessarily have a linear or constant arithmetic relationship. That is why the well test must be conducted periodically on each oil well, or group or oilfield.

FIG. 1 illustrates how a typical known well test is carried out on a known oil well schematically illustrated in FIG. 2.

Referring to FIG. 1, this is a graph schematically illustrating the relationship between the production rate of oil, and the production rate of sand, with respect to time during a typical known well test on a given oil well 150 shown in FIG. 2, or alternatively a group or field of oil wells, as described above. The oil well 150, which may be onshore or offshore, has a wellhead 152 connected by a wellbore 140 to a natural underground oil-containing reservoir (not shown), and a pipeline 154 extending from the wellhead 152 to a processing, transporting by pipeline or storage facility 156. A choke 158 is provided at the wellhead 152 to control the oil flow rate along the pipeline 154, or terminate the oil flow. The pipeline 154 is provided with a diverting line 160 for diverting a portion of the oil flow in order to measure the sand content of the oil flow either online or offline by a sand content measurement device 162.

In FIG. 1 the y-axis 101 represents, independently, the volume rate of oil production and the volume rate of sand production, each of which may be in any desired unit, e.g. bbl/day. The upper dashed line 104 represents the oil production rate along the pipeline 154 and the lower dashed/dotted line 105 represents the sand production rate along the pipeline 154. The dotted line 103 represents the predetermined ASR for the oil well 150 (or group or field) that is being tested. The x-axis 102 represents time in any desired unit, e.g. hours. A typical known well test takes about 5-20 hrs to complete.

In the test the sand production rate is typically measured by taking a sample of the pipeline flow along the pipeline 154 and, in an online or offline analytical process by the sand content measurement device 162, analysing the sample to determine the proportion of sand in the pipeline flow. The flow rate of the pipeline 154 is typically continuously measured using a flow meter 164, and so the sand production rate can be calculated from the proportion of sand in the pipeline flow. The calculated sand production rate can be compared against the predetermined ASR for the oil well (or group or field) that is being tested.

It should be noted that the production rate values shown by these lines, and the increase/decrease of these rates with respect to time are merely exemplary. The actual production rates and changes in production rates would vary between oil wells, and vary over the lifetime of any given oil well.

At the start of the well test, the oil well 150 is in a typical production mode and therefore the sand production is expected to be below the ASR level. Since the production rate of sand is generally related to the production rate of oil, i.e. as the production rate of oil is increased generally the production rate of sand also increases, the initial expected sand level is below the ASR level indicating to the operator/tester that the oil production rate can be increased in order to carry out the test.

This increased oil production rate is achieved by opening the choke 158 on the pipeline 154 from the wellhead 152 to increase oil production from the well 150; as shown in FIG. 1 the oil production rate increases from the initial level as a result of ramp increase 106 to achieve a higher oil production rate at level 107. This increase in the oil production rate causes the sand production rate to increase to a new value 108 that is still below the ASR. Therefore, the production rate can be increased further by ramp increase 109 to a new oil production rate at level 110. However, in this example, the increased oil production rate results in the sand production rate increasing further to a level 111 that is now, undesirably, above the ASR. Excess sand is now being produced.

Since the sand rate is now higher than the maximum threshold ASR value, the operator must reduce the oil production rate quite quickly in order to meet the regulated ASR value and/or to prevent the build-up of collected sand at the surface, i.e. in the environment of the oil field in the vicinity of the oil well 150, and/or to prevent unwanted sand erosion of downstream pipelines, valves and other equipment that is expensive to deal with. On an offshore facility these pipelines can be shared by several fields and damage or blockage is very costly to remediate.

In the typical example shown in FIG. 1, the operator controls the choke 158 which results in the oil production being reduced by a ramp decrease 112 to a new, lower, level 113; the lower oil production rate in turn decreases the sand production rate, in this example to a new, lower, level 114. However, in this example the lower level 114 is still above the ASR value and so the operator controls the choke 158 so that oil production is further decreased by a ramp decrease 115 to a new level 116. This results in the sand production rate decreasing to a level 117 that is now below the ASR. Consequently, by reducing the oil production rate to the new lower level 116, the oil production rate can be left at level 116 until the next periodic test, for example a monthly test period (or any other desired well test period).

As shown in FIG. 1, this typical example of a well test would result in an increase in the oil production from initial level 104 to final level 116 which maintains sand production at level 117 which is below the ASR; level 117 is then taken to be manageable sand rate which can be assumed to be present until the next periodic well test provided that the oil production rate remains at level 116.

It can be seen that the well test has achieved two positive outcomes: (i) the oil production rate has been marginally increased; and (ii) the sand production rate has been reset at a level which continues to be lower than the ASR.

However, during the test much higher oil production rates were achieved, for example at levels 107, 110 and 113, but these oil production rates resulted in higher sand production rates at levels 108, 111 and 114 and two of these oil production rates resulted in excessively high sand rates at levels 111 and 114 which are above the ASR. As will be apparent to those skilled in the art, this test process may employ more or fewer increases or decreases in the oil production rate to achieve the manageable sand rate 117 than are illustrated in the example of FIG. 1.

It is important to note that sand production rate as illustrated by dashed/dotted line 105 consists of two components, namely (a) sand that is being produced from the reservoir continually or continuously; and (b) sand that has been inadvertently stored in the wellbore 140 itself, by the accumulation of sand in the wellbore 140, and has been flushed out of the wellbore 140.

Sand is flushed out of the wellbore by the oil production flow and higher oil flow rates will carry more sand than lower oil flow rates. Also, if the oil production flow rate is lower than that required to overcome the settlement rate, due to gravity, of the sand in the wellbore, then sand will collect in the well. If such sand accumulation is left unchecked then the accumulated volume of sand may get to a point where the sand can 'choke' the oil production from the well completely. As a result, a well test also performs a wellbore cleanout to remove sand stored in the wellbore, preferably as much as possible of that stored sand. The wellbore cleanout is achieved by increasing the oil production rate during the well test as shown in FIG. 1.

The known well test as described above with reference to FIG. 1 suffers from the problem that although the well test has increased the oil production rate, and has reset the sand production rate at a level which continues to be lower than the ASR, nevertheless the oil production rate has only been marginally increased.

The known well test also suffers from the problem that the well test has not enabled the oil production rate to be optimised for any given oil well, or group or field of oil wells.

Accordingly, there is a need in the art of oil production for a method, and an associated apparatus, for carrying out a well test to determine the sand production rate of an oil well, or group or field of oil wells, which can achieve a significantly higher increase in the oil production rate as compared to the initial rate prior to the test than is achievable using the known well test as described above and can reset the sand production rate at a level which continues to be lower than the ASR.

There is a further need in the art of oil production for a method, and an associated apparatus, for carrying out a well test which can also perform a wellbore cleanout to remove all sand accumulated in the wellbore.

There is also a need for such a method, and an associated apparatus, for carrying out a well test to determine the sand production rate of an oil well, or group or field of oil wells, which can optimise the subsequent oil production rate as a result of carrying out the test while still maintaining as subsequent sand production rate at a level is lower than the ASR.

The present invention aims at least partially to overcome these problems, and meet these needs in the art, in known oil production technology.

SUMMARY OF THE INVENTION

Accordingly, in a first aspect the present invention provides a method of controlling sand production from an oil well, the method comprising the steps of:

(a) providing a continuous output production flow from a wellhead of an oil well connected to an oil-containing reservoir, the output production flow comprising hydrocarbon-containing oil at an oil production rate and sand at a sand production rate, and the output production flow being conveyed by a pipeline from the wellhead to a facility for processing, transporting by pipeline, or storing the oil;

(b) at a sand management station along the pipeline between the wellhead and the facility, passing the output production flow through a sand management system installed in the pipeline, wherein the sand management system comprises a solids separator configured to separate sand from the oil of the output production flow, wherein the sand management system has an input which receives the output production flow from the wellhead along an upstream part of the pipeline, the upstream part being upstream of the sand management system, and an oil output which outputs the oil, having sand separated therefrom, along a downstream part of the pipeline, the downstream part being downstream of the sand management system;

(c) opening a choke of the wellhead to increase the oil production rate and sand production rate, whereby the sand production rate is increased to a level higher than an allowable sand rate (ASR) which is a predetermined maximum threshold sand production rate of the pipeline, and, at least during a time period when the sand production rate is higher than the allowable sand rate (ASR), continuously or continually separating sand in the output production flow from the oil of the output production flow using the solids separator of the sand management system to provide a zero or non-zero reduced sand flow in the downstream part of the pipeline;

(d) after or during step c), measuring sand flow in at least one of the sand management system and the downstream part of the pipeline to provide a reduced sand flow rate, which is a flow rate of the reduced sand flow, in the downstream part of the pipeline;

(e) comparing the reduced sand flow rate with the allowable sand rate (ASR) to provide a sand rate comparison value; and (f) controlling the oil production rate using the sand rate comparison value to maintain the reduced sand flow rate in the downstream part of the pipeline below the allowable sand rate (ASR).

Typically, the sand rate comparison value comprises, or is, a sand rate control parameter which is used to control the sand rate in the controlling step (f).

Preferably, in step (e) the reduced sand flow rate and the allowable sand rate (ASR) are compared to determine the sand rate comparison value, and typically thereby the sand control parameter, and to confirm that the measured reduced sand flow rate is below the allowable sand rate (ASR), and in step (0 the oil production rate is controlled using the sand rate comparison value, and typically thereby the sand control parameter, by controlling the choke to set the oil production rate to a set production rate corresponding to the oil production rate in step (c).

In summary, typically the sand rate comparison value determined at a given oil production rate in step (c) is used to control the oil production rate by controlling the choke to set the oil production rate to a set production rate corresponding to the oil production rate in step (c) when the sand rate comparison value is used to confirm that the measured reduced sand flow rate, at that given oil production rate, is below the allowable sand rate (ASR). Since the oil production rate is associated with the sand rate, the sand rate comparison value is used to control the sand rate, by being used to control the oil production rate, and so the sand rate comparison value functions as, and therefore typically comprises, or is, a sand rate control parameter.

In a second aspect, the present invention provides an apparatus for controlling sand production from an oil well, the apparatus comprising a sand management system comprising:

a solids separator configured to separate sand from a continuous output production flow from a wellhead of an oil well having an oil-containing reservoir, the output production flow comprising hydrocarbon-containing oil and sand, the solids separator having an input for receiving the output production flow from the wellhead along an upstream part of a pipeline, the upstream part being upstream of the sand management system, and an oil output for outputting the oil, having sand separated therefrom, along a downstream part of the pipeline, the downstream part being downstream of the sand management system, a control system for controlling the choke of the wellhead thereby to vary the oil production rate and sand production rate from the oil well, and a measurement device for directly or indirectly measuring a flow rate of a zero or non-zero reduced sand flow in the downstream part of the pipeline to provide a measured reduced sand flow rate, which is a flow rate of the reduced sand flow in the downstream part of the pipeline, wherein the control system comprises:

a data storage module configured to store an allowable sand rate (ASR) which is a predetermined maximum threshold sand production rate of the pipeline, a comparator module for comparing the measured reduced sand flow rate, received from the measurement device, with the allowable sand rate (ASR) to provide a sand rate comparison value; and an oil flow rate control module for outputting a control signal to the choke for controlling the oil production rate, wherein the oil flow rate control module processes the sand rate comparison value to maintain the reduced sand flow rate downstream of the sand management system below the allowable sand rate (ASR).

Typically, the sand rate comparison value comprises, or is, a sand rate control parameter which is used to control the sand rate during the controlling of the oil production rate by the choke.

Preferably, the comparator module is arranged to compare the measured reduced sand flow rate and the allowable sand rate (ASR) to determine the sand rate comparison value, and typically thereby the sand control parameter, and to confirm that the measured reduced sand flow rate is below the allowable sand rate (ASR), and the oil flow rate control module is arranged, by processing the sand rate comparison value, and typically thereby the sand control parameter, to control the choke to set the oil production rate to a set production rate corresponding to the oil production rate which produced the measured reduced sand flow rate measured by the measurement device.

BRIEF DESCRIPTION OF THE DRAWINGS

Embodiments of the present invention will now be described in more detail by way of example only with reference to the accompanying drawings, in which.

DETAILED DESCRIPTION

Figure 3:
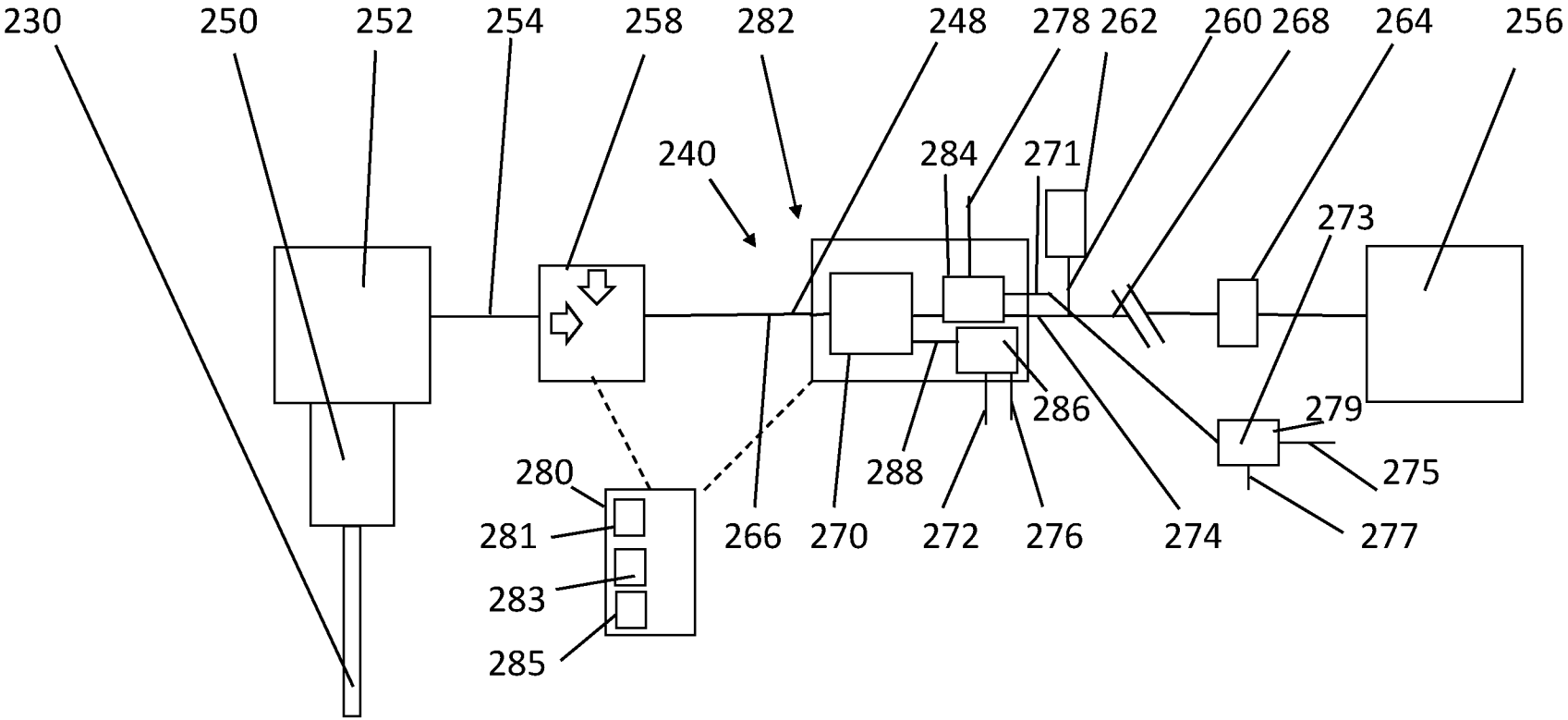
FIG. 3 schematically illustrates an apparatus for controlling sand, and comprising a sand management system, in accordance with an embodiment of an apparatus of the present invention.

Referring to FIG. 3 there is schematically illustrated an apparatus for controlling sand production from an oil well, the apparatus comprising a sand management system 240, in accordance with an embodiment of the present invention.

The sand management system 240 is connected to a given oil well 250 shown in FIG. 3, which may alternatively comprise a group or field of oil wells, as described above. The oil well 250, which may be onshore or offshore, has a wellhead 252 connected by a wellbore 230 to a natural underground oil-containing reservoir (not shown), and a pipeline 254 extending from the wellhead 252 to a processing, transporting by pipeline, or storage facility 256. There is a continuous output production flow from the wellhead 252 comprising hydrocarbon-containing oil and sand. A choke 258 is provided at the wellhead 252 to control the oil flow rate along the pipeline 254, or terminate the oil flow. The downstream part 268 of the pipeline 254, downstream of the sand management system 240, is provided with a diverting line 260 for diverting a portion of the oil flow in order to measure the sand content of the oil flow either online or offline by a sand content measurement device 262. At a sand management station 282 along the pipeline 254 between the wellhead 252 and the facility 256, the sand management system 240 is installed in the pipeline 254.

The input of the sand management system 240 continuously receives the output production flow from the wellhead 252 and the oil output of the sand management system 240 continuously or continually outputs the oil, having sand separated therefrom, along the downstream part 268 of the pipeline 254.

The sand management system 240 comprises a solids separator 270 configured to separate sand from the oil of the output production flow. The solids separator 270 is typically a centrifugal separator, but any suitable separator known in the oil production industry as being suitable for use in separating sand particles from oil may be used. The sand management system 240 has an input 248 which receives the output production flow from the wellhead 252 along an upstream part 266 of the pipeline 254 and an oil output 274 which outputs the oil, having sand separated therefrom, along the downstream part 268 of the pipeline 254. The sand management system 240 also has a sand outlet 272, a water outlet 271 and a gas outlet 278.

A control system 280 is coupled either by a wireless or wired connection to the sand management system 240 for controlling the choke 258 of the wellhead 252 thereby to vary the oil production rate and sand production rate from the oil well 250.

The sand content measurement device 262 measures the reduced sand flow rate in the downstream part 268 of the pipeline 254 to provide a measured reduced sand flow rate.

In an alternative embodiment of the present invention, the sand content measurement device 262 may be incorporated into the sand management system 240 to measure the sand flow rate of the oil outputted from the sand management system 240.

In a further alternative embodiment of the present invention, the sand content measurement device 262 is not provided; instead, a first measurement device for measuring the sand flow rate entering the sand management system 240 and a second measurement device for measuring the rate of sand separated by the solids separator 270 may be provided, either as independent devices or in a common measurement system. The measurements of the first and second measurement devices can be used to calculate the reduced sand flow rate in the downstream part 268 of the pipeline 254, for example by deducting the rate of sand separated by the solids separator 270 from the sand flow rate entering the sand management system 240. The sand management system 240 further comprises a solids outlet 288 connected to the solids separator 270 such that the sand separated by the solids separator 270 from the hydrocarbon-containing oil can be removed from the solids separator 270 through the solids outlet 288.

In accordance with the broadest aspect of the present invention, the sand management system 240 may simply comprise the solids separator 270 to separate sand from the hydrocarbon-containing oil. The solids separator 270 may comprise any device suitable for separating sand from the hydrocarbon-containing oil; in the preferred embodiment a centrifugal separator is employed, although other devices may alternatively be used. The sand exits the solids outlet 288 connected to the solids separator 270. As described hereinbelow, in accordance with a preferred embodiment of the present invention, the separated sand is subsequently processed on-site, in particular cleaned. However, in alternative embodiments of the present invention the sand separated from the hydrocarbon-containing oil is not subsequently processed. Furthermore, in accordance with a preferred embodiment of the present invention, water present in the multiphase fluid from the oil production, is used to clean the sand, and the water is also subsequently cleaned, and gas present in the multiphase fluid from the oil production is also separated. These water and gas treatments are also only preferred aspects of the present invention.

In accordance with the preferred embodiment as illustrated in FIG. 3, a solids cleaning system 286 is connected to the solids outlet 288. The solids cleaning system 286 is configured to clean deposits of residual oil from the sand separated by the solids separator 270 to provide cleaned sand and first residual oil. The solids cleaning system 286 has a first output 272 for outputting the cleaned sand and a second output 276 configured for outputting the first residual oil.

The sand management system 240 further comprises a fluid separator 284 in fluid communication with the solids separator 270 and arranged to receive a remaining multiphase hydrocarbon-containing oil from the solids separator 270. The fluid separator 284 is configured to separate the remaining multiphase hydrocarbon-containing fluid into an oil phase, a water phase and a gas phase. The water outlet 271 is connected to the fluid separator 284 such that the water phase can be removed from the sand management system 240 through the water outlet 271.

A water cleaning and recycling system 273 is connected to the water outlet 271. The water cleaning and recycling system 273 is configured to clean residual oil from the water phase separated by the fluid separator 284. The water cleaning and recycling system 273 comprises an oil separator 279 for separating the residual oil from the water phase to provide cleaned water and second residual oil The oil separator 279 has a third output 275 for outputting the cleaned water, and a fourth output 277 for outputting the second residual oil.

As described further hereinbelow, in use the oil production flow in the pipeline 254 is passed through the sand management system 240 which functions to remove sand, i.e. solids particles, from the hydrocarbon-containing oil.

The sand management system 240 carries out the following steps: first, the sand is separated from the hydrocarbon-containing oil using the solids separator 270. The separated sand and the remaining hydrocarbon-containing oil are independently outputted from the solids separator 270.

Typically, the solids separator 270 removes sand from the multiphase hydrocarbon-containing fluid whereby the sand content of the remaining multiphase hydrocarbon-containing fluid entering the fluid separator 284 is lower than 1 weight %, optionally within the range of from 0.5 to 1 weight %, based on the total weight of the remaining multiphase hydrocarbon-containing fluid. Typically, the solids separator 270 removes sand from the multiphase hydrocarbon-containing fluid whereby the hydrocarbon content of the sand exiting the solids outlet 288 is lower than 10 weight %, optionally within the range of from 5 to 10 weight %, based on the total weight of the separated sand.

Then, the sand is cleaned by cleaning residual oil deposits from the sand separated by the solids separator 270 in the solids cleaning system 286 connected to the solids output 288 of the solids separator 270. The solids cleaning system 286 may function by cleaning the sand centrifugally or by washing with high pressure water, although other techniques may be employed. The cleaned sand is outputted from the solids cleaning system 286. Such cleaned solid particles, such as sand, are sufficiently free of residual hydrocarbons that in most, if not all, oil producing countries it is legally and environmentally acceptable to dispose of the cleaned sand locally in the vicinity of the oil well.

Also, residual oil is outputted from the solids cleaning system 286, which may be recycled to the fluid separator 284.

Typically, the hydrocarbon-containing oil and the sand are present in a multiphase hydrocarbon-containing fluid of the oil production flow which comprises an oil phase, a sand phase, a water phase and a gas phase. When such a multiphase hydrocarbon-containing fluid, preferably the sand management system 240 carries out the following further steps: after separating sand from the hydrocarbon-containing oil using the solids separator 270, the remaining multiphase hydrocarbon-containing oil is separated into an oil phase, a water phase and a gas phase in the fluid separator 284 which is in fluid communication with the solids separator 270. The oil phase, the gas phase and the water phase are independently removed from the fluid separator 284. The oil phase is removed from the separation system through the oil output 274, the gas phase is removed through the gas outlet 278 and the water phase is removed through the water outlet 271.

Any residual oil in the water phase which is separated by the fluid separator 284 is cleaned from the water phase by the water cleaning and recycling system 273 connected to the water outlet 271 of the fluid separator 284. The oil separator 279 separates oil from the water phase to provide cleaned water and second residual oil. The oil separator 279 outputs the cleaned water, and outputting the residual oil. The residual oil may be recycled to the sand management system 240, to the pipeline 254, to the fluid separator 284 or to the solids separator 270.

Typically, the fluid separator 284 removes water from the oil phase whereby the water content of the oil phase exiting the oil output 274 is lower than 2 weight %, optionally within the range of from 1 to 2 weight %, based on the total weight of the oil phase.

Typically, the fluid separator 284 removes oil from the water phase whereby the oil content of the water phase exiting the fluid separator 284 is lower than 500 ppm by weight, optionally within the range of from 300 to 500 ppm by weight, based on the total weight of the water phase.

Subsequently, preferably the oil separator 279 separates oil from the water phase whereby the oil content of the cleaned water is lower than 20 ppm by weight, optionally within the range of from 5 to 20 ppm by weight, based on the total weight of the cleaned water.

Typically, the sand management system 240 removes hydrocarbons from the sand whereby the hydrocarbon content of the cleaned sand is lower than 1 weight %, based on the total weight of the cleaned sand.

Figure 4:
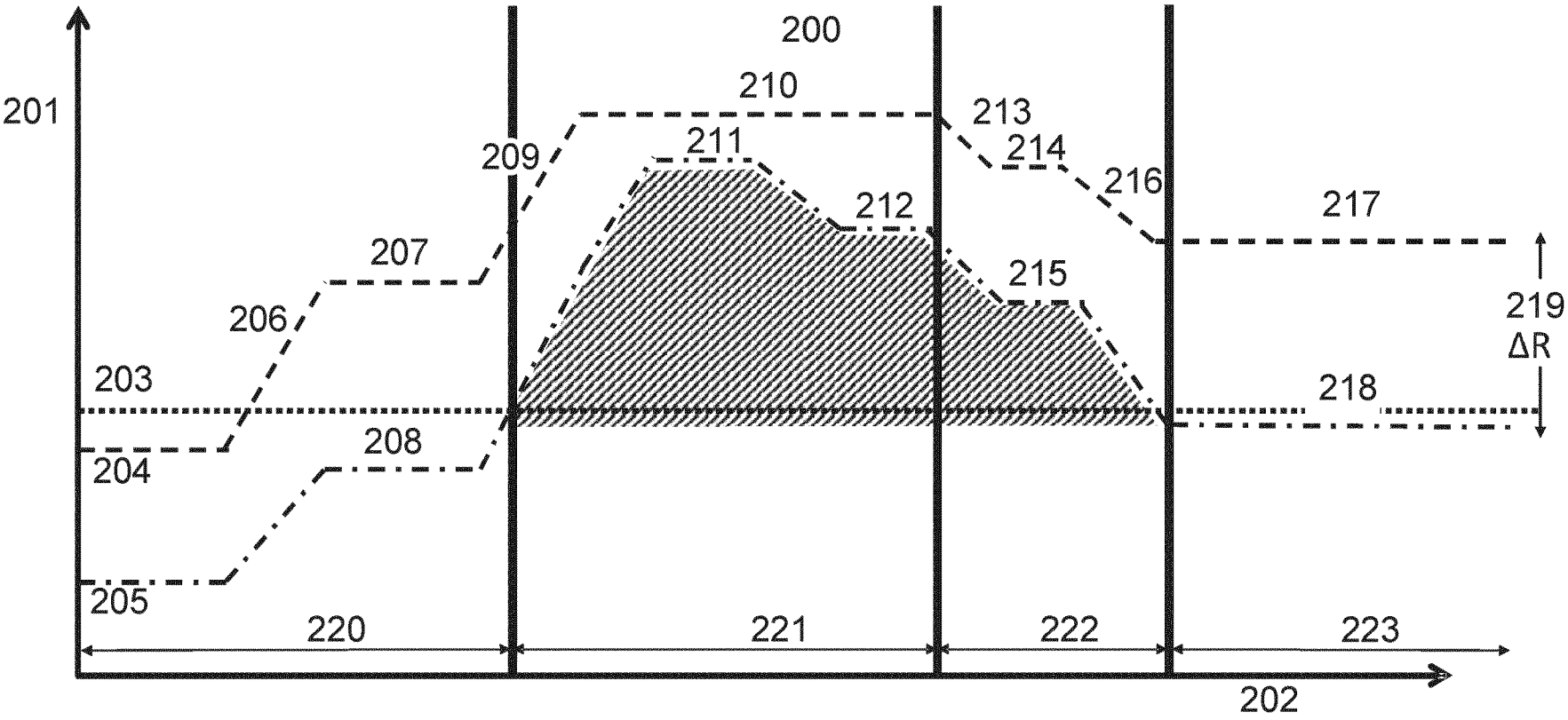
FIG. 4 is a graph schematically illustrating the relationship between the production rate of oil, and the production rate of sand, with respect to time during a periodic well test, using a sand management system as illustrated in FIG. 3, in a method of controlling sand production from an oil well in accordance with a first embodiment of the method of the present invention, the method being carried out on a given oil well, or group or field of oil wells.

Referring now to FIG. 4, there is shown a graph schematically illustrating the relationship between the production rate of oil, and the production rate of sand, with respect to time during a well test using a sand management system, for example the sand management system illustrated in FIG. 3, in a method of controlling sand production from an oil well in accordance with a first embodiment of the present invention, the method being carried out on a given oil well, or group or field of oil wells. The oil well(s) may be onshore or offshore. It should be noted that although the method described herein is a well test performed on one well, it is possible that the test could be performed on a group of wells or on an oil field, that is, oil production from many wells is combined into a single pipeline and the test is performed on this combined flow.

As described above, in accordance with the broadest aspect of the present invention, the sand management system may simply comprise a solids separator to separate sand from the hydrocarbon-containing oil. The solids separator may comprise any device suitable for separating sand from the hydrocarbon-containing oil. Optionally, but not essentially, the separated sand may be processed on-site, for example by cleaning, and water and gas phases in a multiphase fluid of the oil production may also be processed.

In accordance with this aspect of the present invention, a sand management system, which can separate sand from the oil production, is used during a well test to determine the sand production characteristics as a function of the oil production rate, and to use the determined characteristics to increase, preferably optimise, oil production from the well without excessive sand production in the downstream pipeline or processing, transporting by pipeline, or storage facility.

The wellhead 252 of the oil well 250 is connected by the wellbore 230 to an oil-containing reservoir (not shown). During the test, a continuous output production flow is provided from the wellhead 252. The output production flow comprises hydrocarbon-containing oil at an oil production rate and sand at a sand production rate, and the output production flow is conveyed by the pipeline 254 from the wellhead 252 to the facility 256 for processing, transporting by pipeline, or storing the oil.

At the sand management station 282 along the pipeline 254 between the wellhead 252 and the facility 256, the output production flow is passed through the sand management system 240 installed in the pipeline 254, as described above. The sand management system 240 comprises the solids separator 270 configured to separate sand from the oil of the output production flow. The input 248 of the sand management system 240 receives the output production flow from the wellhead 252 along the upstream part 266 of the pipeline 254, upstream of the sand management system 240, and the oil output 274 outputs the oil, having sand separated therefrom, along the downstream part 268 of the pipeline 254.

The well test is illustrated in FIG. 4. In FIG. 4, they axis 201 and the x-axis 202 respectively represent production rates and time, as described above for FIG. 1. The allowable sand rate (ASR) is represented by dotted line 203, the oil production rate is shown by line 204 and the sand production rate by line 205. In FIG. 4, the test sequence is broken into 4 distinct time periods 220, 221, 222 and 223 that are described hereinbelow.

Figure 1:
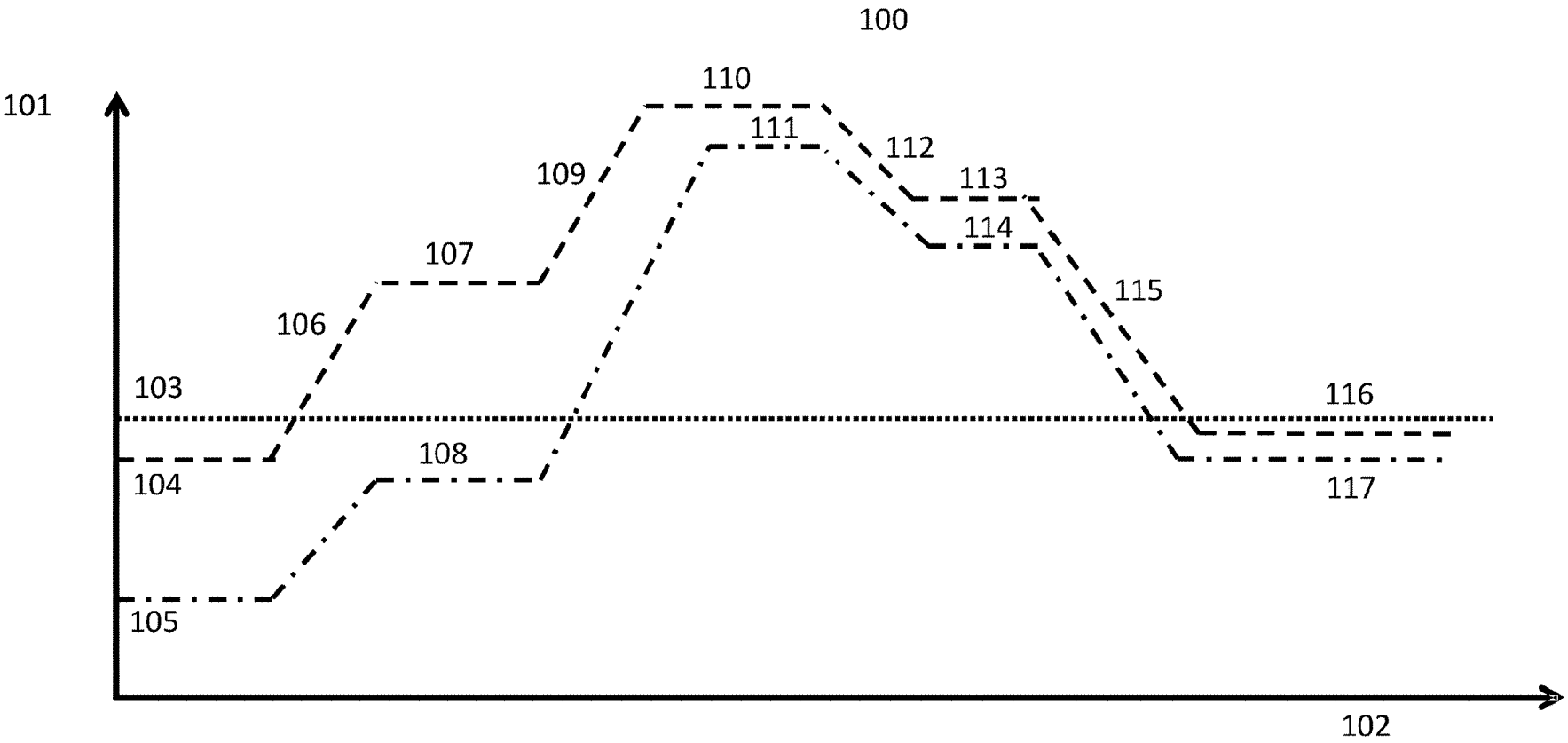
FIG. 1 is a graph schematically illustrating the relationship between the production rate of oil, and the production rate of sand, with respect to time during a typical known well test on a given oil well, or group or field of oil wells.
Figure 2:
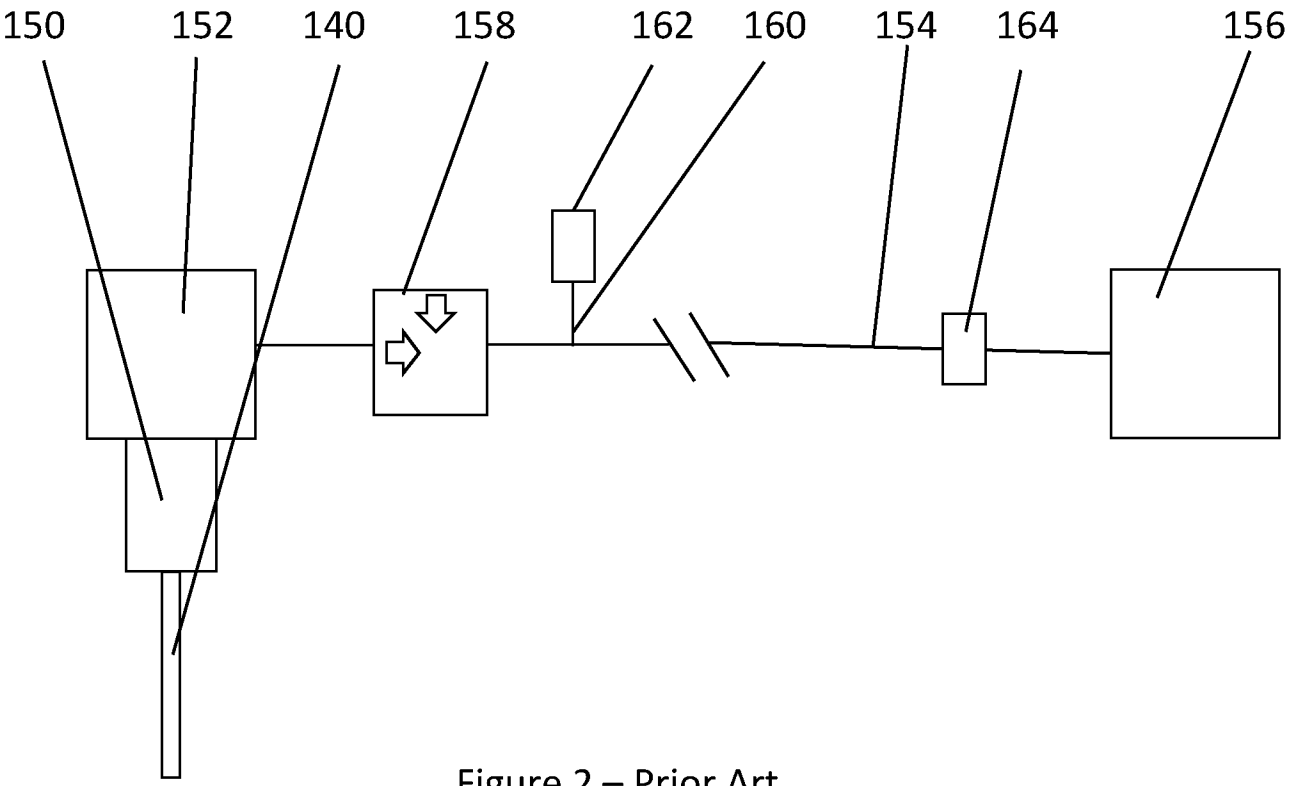
FIG. 2 schematically illustrates a known wellhead and pipeline arrangement which is used for carrying out the typical known well test illustrated in FIG. 1.

Similar to FIG. 1, FIG. 4 schematically illustrates a monthly (or some other period, for example at least one week or at least one month) well test but in this case a compact sand separation, collection and also potentially sand washing unit is temporarily installed during the well test, for example the sand management system 240 as shown in FIG. 3. Alternatively, the unit may be a solids separator, for example as disclosed in WO-A-2016/075317. Other solids separators, such as hydrocyclone separators, for separating solid particles, such as sand, from multiphase hydrocarbon-containing fluids in the oil and gas production industry are known to those skilled in the art of oil and gas production.

At the start of well test during time period 220, the sand management system 240 is connected to receive the production flow from the well 250 undergoing the well test. This allows produced sand to be continuously or continually separated from the oil production. The sand management system 240 collects the sand so the sand content of the oil production can be managed as required. For example, the sand management system 240 could simply store the sand for removal after the test or, as illustrated in FIG. 3, the sand management system 240 may incorporate a sand washing arrangement to clean the hydrocarbons from the sand particles so that sand can be disposed of at the wellsite in an environmentally safe manner.

Returning to FIG. 4, at the beginning of time period 220, the sand production, as measured by the sand measurement device 262, or another measurement device, prior to installation of the sand management system 240 and therefore prior to separation of sand from the oil production flow, or as described above as measured by the sand management system 240 after installation of the sand management system 240, is below the ASR. This sand content level indicates to the operator that oil production can be increased without necessarily exceeding the ASR. In other words, at the beginning of the test the operator determines that there is some possibility to carry out the test to generate data on the sand content which can then be used to increase the oil production without generating excess sand in the oil production flow, which would otherwise compromise the flow capacity of the pipeline or downstream operations.

As shown by upward ramp 206, as the test is commenced the choke 258 on the wellhead 252 which is installed on the production pipeline 254 is opened to increase oil production to a higher level 207. The increased oil production rate correspondingly results in the sand production rate increasing to a higher level 208.

The oil production rate is increased to a value so that the associated sand flow rate from the reservoir is no greater than a predetermined maximum threshold, which maximum threshold has been determined or estimated to avoid damage to the wellbore 230 and wellhead 252 upstream of the sand management system 240 and/or damage to the reservoir or a formation above the reservoir.

In this example, the operator has selected an increased oil production rate that has resulted in a sand production rate at the higher level 208 which is nevertheless still below the ASR.

Therefore, again the operator determines that there is still some further possibility to try to increase the oil production, and the choke 258 is opened further so that the oil production increases, by upward ramp 209, to the even higher level 210.

Accordingly, in the method of the present invention, the choke 258 of the wellhead 252 is opened to increase the oil production rate and sand production rate, whereby the sand production rate is increased to a level higher than an allowable sand rate (ASR) which is a predetermined maximum threshold sand production rate of the pipeline 254. At least during a time period, for example time period 221, when the sand production rate is higher than the allowable sand rate (ASR), sand in the output production flow is continuously or continually separated from the oil of the output production flow using the solids separator 270 of the sand management system 240.

The removal of sand by the solids separator 270 provides a zero or non-zero reduced sand flow in the downstream part 268 of the pipeline 254.

In this example test of FIG. 4, the sand management system 240 is connected to the well 250, and therefore sand is removed from the oil production flow by the solids separator 270. Unlike the known well test described in FIG. 1, with the sand management system 240 connected to the well 250 as shown in FIG. 3, it is not necessary to reduce the oil production rate even if the sand production rate in the upstream part 266 of the pipeline 254 prior to the sand management system 240 is above the ASR: this is because the sand is separated from the oil production flow by the sand management system 240. The resultant reduced sand flow in the downstream part 268 of the pipeline 254 can be maintained below the ASR.

Therefore, the higher oil production rate is maintained at level 210 during a wellbore cleanout time period 221.

In the wellbore cleanout time period 221, the increased oil production rate removes the sand that has become inadvertently accumulated, or stored, in the wellbore 230, and this removal of accumulated sand causes a significant increase in the sand production rate in the upstream part 266 of the pipeline 254. As this accumulated/stored sand is removed from the wellbore 230, the sand production decreases to level 212, which represents the sand production from the reservoir due to the increased oil production. In other words, the increased oil flow rate from the reservoir, which also increases the sand production rate from the reservoir, additionally causes a temporary increase, or "spike", in the sand production rate from the wellbore 230 as a result of the higher oil flow causing dislodging and removal of accumulated or stored sand in the wellbore 230. This sand removal constitutes a "wellbore cleanout". Accordingly, in the typical method of the present invention, after the commencement of the step of opening the choke, the oil production rate and the sand production rate are permitted, after an initial increase in sand flow rate at least partially resulting from the removal of accumulated sand from the wellbore 230, to stabilise to respective stabilised values of the oil and sand production rates exiting the reservoir of the oil well. The stabilised oil level is level 210 and the stabilised sand level is level 212.

The test method then proceeds to the next time period 222, during which the sand rate is lowered to a value below the ASR as a result of sand being produced from the reservoir alone. This lower sand production rate is achieved by the operator closing the choke 258 on the oil production line 254 to reduce the oil production rate by a downward ramp 213 to a lower level 214. In this example, this lowering of the oil production rate results in the reduced sand flow rate reducing to a lower level 215 that is still above the ASR. The new reduced sand flow rate, as a result of sand removal by the solids separator 270, is determined in this embodiment by using the sand measurement device 262.

Therefore, the choke is closed further by the operator, to reduce the oil production rate by a downward ramp 216 to a lower level 217. This correspondingly results in a lower reduced sand flow rate, at level 218, which is below the ASR. This still lower reduced sand flow rate is determined in this embodiment by using the sand measurement device 262.

Accordingly, the oil production rate can be set at the level 217 as the new oil production rate for the subsequent oil production time period 223, for example for following month, or for the time period prior to the next well test. Therefore, at the commencement of time period 223 the operator has, during the well test, set the oil production rate to a higher "steady state" value until the next well test, which has correspondingly set the reduced sand flow rate to a "steady state" value below the ASR.

It may be seen that the well test of this embodiment of the present invention has achieved a significantly higher increase in the oil production rate, at level 217, as compared to the initial rate prior to the test, at level 204, than is achievable using the known well test as described above, and has also performed a wellbore cleanout to remove all sand accumulated or stored in the wellbore 230, and has reset the sand production rate at a level, i.e. level 218, which continues to be lower than the ASR. The oil production rate has been increased without exceeding the ASR in the downstream part 268 of the pipeline 254 either during the test or after the test.

The cross-hatch area shown during time periods 221 and 222 in FIG. 4 represents the volume of sand captured by the sand management system 240 during the well test. As a result of this test method of this embodiment of the present invention, an additional oil production rate $\Delta R$, indicated by arrowed line 219, is achieved in addition to the oil production rate achieved during the known, present-day practice shown in FIG. 1. After the commencement of time period 223, the sand management system 240 can be removed from the well 250 and moved onto another well in order carry out the monthly well test on that next well.

Therefore, in accordance with the method of the present invention, after the choke 258 has initially been opened to increase the oil production rate, the reduced sand flow rate in the downstream part 268 of the pipeline 254 is measured to provide a measured reduced sand flow rate. The measured reduced sand flow rate is compared with the allowable sand rate (ASR) to provide a sand rate comparison value, which typically comprises, or is, a sand control parameter. Then the oil production rate is controlled using the sand rate comparison value, which is used as a sand control parameter, to maintain the sand production rate in the downstream part 268 of the pipeline 254 below the allowable sand rate (ASR).

In this embodiment, the sand management system 240 is temporarily installed in the pipeline 254 for a series of intermittent time periods, each intermittent time period comprising a test period during which the sand management system 240 is operational to separate sand from the oil production, and the sequence of the combination of the sand measuring step, the comparison step and the control step as described above is carried out during the test period.

In each test period, during which the sand management system 240 is temporarily installed in the pipeline 254, the sand management system 240 is employed to separate excess sand, in particular increased flow of sand that was accumulated or stored in the wellbore 230, so that the ASR is not exceeded in the downstream part 268 of the pipeline 254. The oil production rate is reset to an increased value which maintains the flow of sand in the downstream part 268 of the pipeline 254 below the ASR, even after the sand management system 240 has been uninstalled following the intermittent test period. The reset oil production rate has a sand production rate, i.e. the rate of sand flow from the reservoir, which is below the ASR. Therefore the sand management system 240 can be uninstalled, and excess sand separation is no longer required, until the subsequent sand test is conducted after a production period of at least one week or at least one month.

In this embodiment of the method of the present invention, after the choke 258 has been opened, as described above, during the test period the choke 258 of the wellhead 252 is subsequently closed to decrease the oil production rate and sand production rate. In this embodiment of the method of the present invention, the choke 258 is closed after the oil production rate and the sand production rate have stabilised, subsequent to an initial increase in sand flow rate at the commencement of the opening of the choke 258 at least partially resulting from the removal of accumulated sand from the wellbore 230, to respective stabilised values of the oil and sand production rates exiting the reservoir of the oil well.

Then the decreased reduced sand flow rate in the pipeline 254 is measured to provide a measured decreased reduced sand flow rate. The measured decreased reduced sand flow rate and the allowable sand rate (ASR) are compared to determine the sand rate comparison value, which typically comprises or is a sand control parameter, which is used to control the sand rate by controlling the oil production rate, to confirm that the measured decreased reduced sand flow rate is below the allowable sand rate (ASR). Thereafter, the oil production rate is set to a set production rate corresponding to the decreased oil production rate, which sets the sand rate as a result of using the sand rate comparison value, as a sand control parameter, to control the oil production rate. Finally, the test period is terminated. After terminating the test period, the sand management system 240 is uninstalled from the pipeline 254 at the end of the test period.

Subsequently, after a production time period during which continuous output production flow is conveyed by the pipeline 254 from the wellhead 252 to the facility 256 for processing, transporting by pipeline, or storing the oil, the sand management system 240 is re-installed on the pipeline 254 and the steps of the well test as described above are repeated. Typically, the production time period is at least one week or at least one month.

Figure 5:
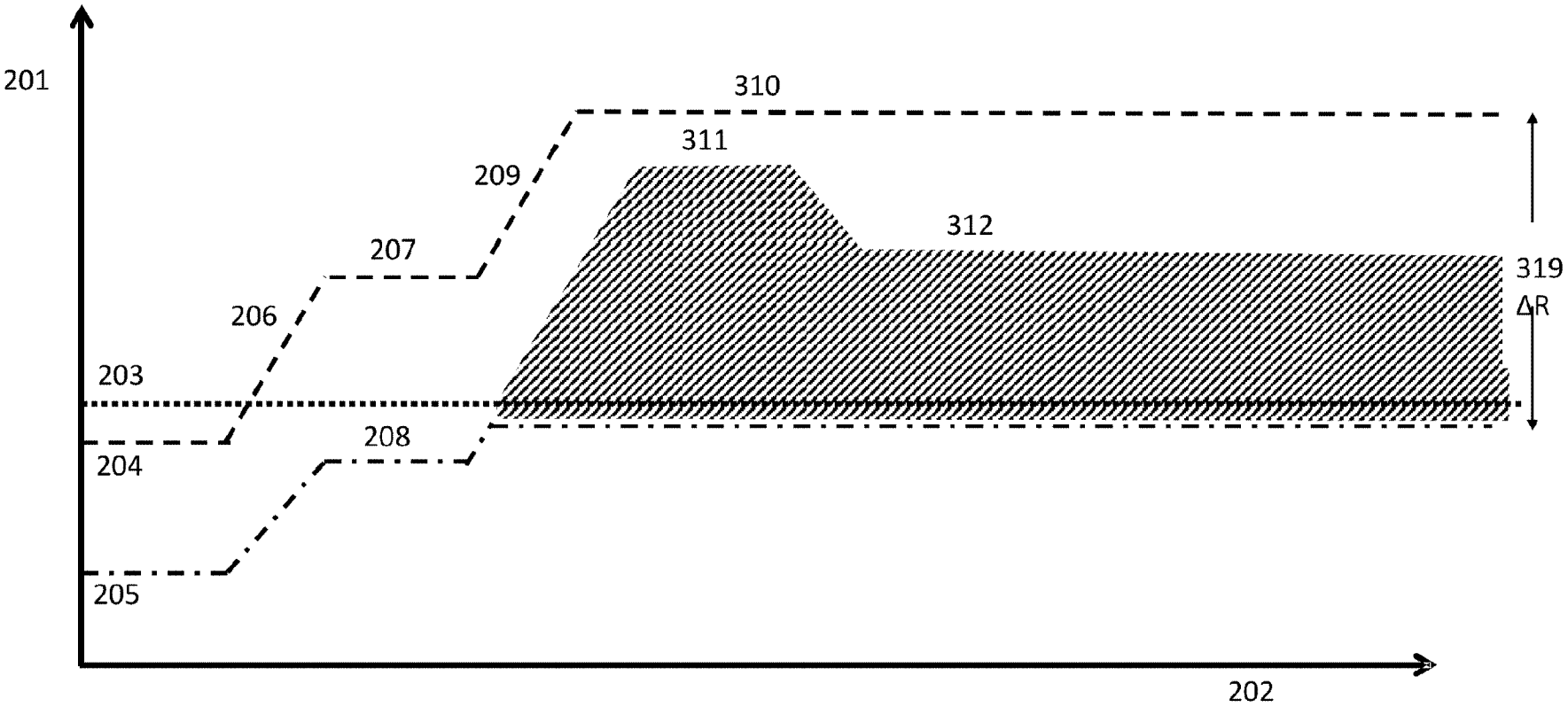
FIG. 5 is a graph schematically illustrating the relationship between the production rate of oil, and the production rate of sand, with respect to time during a continuous well test, using a sand management system as illustrated in FIG. 3, in a method of controlling sand production from an oil well in accordance with a second embodiment of the method of the present invention, the method being carried out on a given oil well, or group or field of oil wells.

FIG. 5 is a graph schematically illustrating the relationship between the production rate of oil, and the production rate of sand, with respect to time during a continuous well test, using a sand management system as illustrated in FIG. 3, in a method of controlling sand production from an oil well in accordance with a second embodiment of the method of the present invention, the method being carried out on a given oil well, or group or field of oil wells.

In the embodiment illustrated in FIG. 5, the sand management system 240 is permanently installed on the well 250 rather than just for the well test period. Accordingly, the sand management system 240 is installed in the pipeline 254 for a continuous oil production time period, and the sequence of the combination of the sand measuring step, the step of comparing against the ASR, and the step of controlling the oil flow based on a sand rate comparison value, which is used as a sand control parameter, is carried out once at a beginning of the continuous oil production time period, or repeatedly at a plurality of times during the continuous oil production time period.

The initial steps are the same as those shown in FIG. 4. In other words, also in this embodiment, after opening the choke 258 so that the sand production flow is greater than the ASR, the following steps are carried out: measuring the reduced sand flow rate in the downstream part 268 of the pipeline 254 to provide a measured reduced sand flow rate; comparing the measured reduced sand flow rate with the allowable sand rate (ASR) to provide a sand rate comparison value; and controlling the oil production rate using the sand rate comparison value to maintain the reduced sand flow rate downstream of the sand management system below the allowable sand rate (ASR).

In this embodiment however, the increased oil production rate 310 is now determined such that the sand management system 240 is capable of handling both the sand accumulated/stored in the wellbore 230 plus the sand continuously produced from the reservoir as a result of the increased oil production rate, i.e. sand production rate 311. The sand produced from the reservoir as a result of the increased oil production rate on an ongoing basis is shown as sand production rate 312.

In this embodiment therefore, a maximum sand separation rate of the sand management system 240 is determined, or provided. This parameter effectively defines the capacity of the given sand management system 240 to be able to separate sand from the incoming oil flow at a given separation rate. Preferably in this embodiment, before the oil production rate is increased at upward ramp 209, the sand production rate in the pipeline 254 is measured by sand measurement device 262 or another device to provide a measured sand production rate from the reservoir. Thereafter, a maximum accumulated sand flow rate of sand at least partially resulting from the removal of accumulated sand from the wellbore 230 is determined or estimated. Then, there is a step of calculating from the measured sand production rate and the maximum accumulated sand flow rate, and from a maximum sand separation rate of the sand management system 240, a first maximum oil production rate that can be conveyed to the sand management system 240 to maintain a reduced sand flow rate below the allowable sand rate (ASR) at the output of the sand management system 240, whereby excess sand above the allowable sand rate (ASR) is separated from the oil by the solids separator 270. As described above, in this embodiment the oil production rate is increased by upward ramp 209 to a level 310, and level 310 is no greater that the calculated first maximum oil production rate.

The new increased oil production rate 310 is maintained as a "steady-state" oil production rate during a continuous oil production period. The cross-hatch area in FIG. 5 represents the sand volume captured by the sand management system 240 during the well test period and the continuous oil production period. Since the sand management system 240 is installed permanently on the well 250, the reduced sand flow rate can be continuously or continually checked by the sand measurement device 262.

This new method results in an increase, ΔR, in the oil production, as shown by arrowed line 319, as compared to the initial oil production rate, 204, before the installation of the sand management system 240 and the carrying out of the well test.

Figure 6:
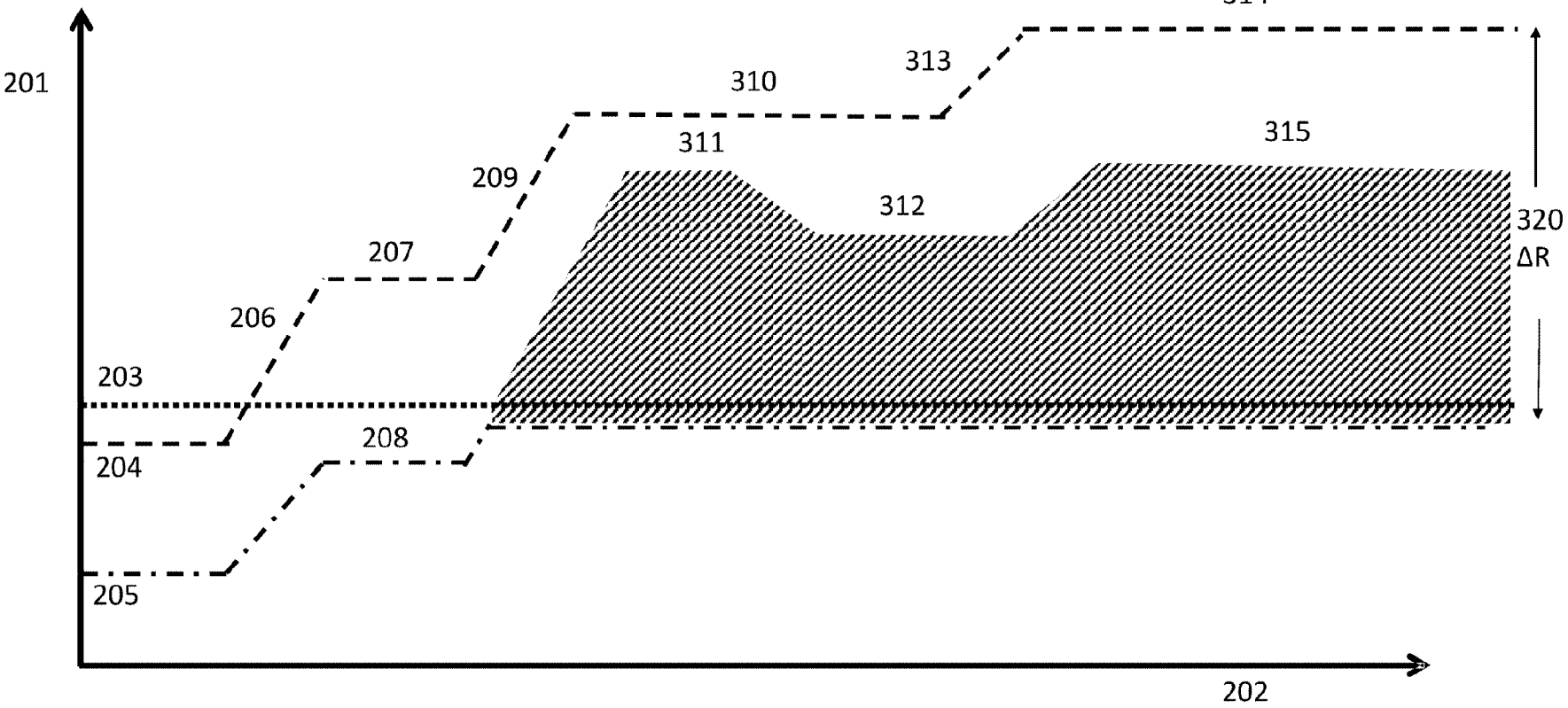
FIG. 6 is a graph schematically illustrating the relationship between the production rate of oil, and the production rate of sand, with respect to time during a continuous well test, using a sand management system as illustrated in FIG. 3, in a method of controlling sand production from an oil well in accordance with a third embodiment of the method of the present invention, the method being carried out on a given oil well, or group or field of oil wells.

However, if the increased sand rate is now such that it does not cause erosion/damage concerns for the wellhead 252 and/or other equipment upstream of the sand management system 240, and does not damage the reservoir or the formation above the reservoir, then a further increase in oil production can be established as shown in the embodiment of FIG. 6.

FIG. 6 is a graph schematically illustrating the relationship between the production rate of oil, and the production rate of sand, with respect to time during a continuous well test, using a sand management system as illustrated in FIG. 3, in a method of controlling sand production from an oil well in accordance with a third embodiment of the method of the present invention, which is a modification of the second embodiment, the method being carried out on a given oil well, or group or field of oil wells.

As shown in FIG. 6, and as previously described with reference to FIG. 5, after the sand production rate has stabilised at level 312 and this rate has been measured, by use of the sand measurement device 262 or another device, and confirmed to be below a level that would potentially cause damage to the wellhead 252 and other equipment, then the choke 258 on the wellhead 252 is opened further, as shown by upward ramp 313, to increase the production to level 314. This increase in the oil production rate results in an increase in the sand production rate to a level 315. If this is level 315 is below a sand production rate that can cause damage to the wellhead 252, then the new production rate, at level 314, can be held at this level until the next monthly well test. It will be apparent to those skilled in the art that this further additional oil production rate at level 314 can be achieved through further increases and/or decreases in the oil production rate until a manageable long-term sand production rate is achieved. This method thus provides a significantly increase ΔR, which is typically optimised, in the oil production rate 320 as compared to the initial oil production rate 204 as shown in FIG. 4.

Referring to FIG. 6, in this embodiment, after the increase in the oil production rate by upward ramp 209, and after the stabilised values of the oil and sand production rates exiting the reservoir of the oil well have been achieved, typically the stabilised sand production rate in the pipeline is measured to provide a measured stabilised sand production rate. Then there is a step of calculating from the measured stabilised sand production rate and the maximum sand separation rate a second maximum oil production rate that can be conveyed to the sand management system to maintain a reduced sand flow rate below the allowable sand rate (ASR) at the output of the sand management system, whereby excess sand above the allowable sand rate (ASR) is separated from the oil by the solids separator. Thereafter, the oil production rate is further increased to a level 314 which is below the calculated second maximum oil production rate.

It is possible that for any given oil well the sand output of the reservoir may generally vary over time, and in particular may increase over time. If the measured reduced sand flow rate varies relative to the allowable sand rate (ASR) a well test can be repeated in order to try maximise the oil production rate while maintaining the sand flow rate below the ASR, and the sequence of the combination of the sand measuring, comparing and controlling steps is repeated after the step of increasing the oil production rate has been repeated.

The methods of the embodiments of FIGS. 4 to 6 may be carried out by an on-site operator by taking measurements from the sand measurement device 262 and using independent, e.g. manual, control of the choke 258 in order locally to control the oil production. However, in these embodiments the sand management system 240 may be configured as further illustrated in FIG. 3 to permit automatic, and optionally remote, control of the sand management system 240 and the choke 258, and thereby the oil production to maintain the reduced sand flow rate below the ASR. Such automatic, and optionally remote, control of the sand management system 240 and the choke 258 is particularly beneficial in the embodiments of FIGS. 5 and 6 in which the sand management system 240 is installed in the pipeline 254 either permanently or for an extended production period of, for example, more than 3 months.

In order to provide such automatic and/or remote control, as shown in FIG. 3, in the illustrated embodiment the control system 280 comprises a data storage module 281 configured to store an allowable sand rate (ASR) which is a predetermined maximum threshold sand flow rate of the pipeline 254. This value can be determined by the operator, set by local regulations, or calculated for any given pipeline, as is known to those skilled in the art. The control system 280 also comprises a comparator module 283 for comparing the measured reduced sand flow rate, received from the measurement device 262 or another device, with the allowable sand rate (ASR) to provide a sand rate comparison value. The control system 280 further comprises an oil flow rate control module 285 for outputting a control signal to the choke 258 for controlling the oil production rate. The oil flow rate control module 285 processes the sand rate comparison value, which is used as a sand control parameter, to maintain the reduced sand flow rate downstream of the sand management system below the allowable sand rate (ASR).

As described above, the control system 280 may thereby enable automatic and remote control of the sand management system 240 and the choke 258, particularly when the sand management system 240 is permanently installed in the pipeline 254.

Various modifications to the present invention may be made by the person skilled in the art of oil production without departing from the scope of the present invention as defined in the appended claims.

The invention claimed is:

1. A method of controlling sand production from an oil well, the method comprising the steps of:

(a) providing a continuous output production flow from a wellhead of an oil well connected to an oil-containing reservoir, the output production flow comprising hydrocarbon-containing oil at an oil production rate and sand at a sand production rate, and the output production flow being conveyed by a pipeline from the wellhead to a facility for processing, transporting by pipeline, or storing the oil;

(b) at a sand management station along the pipeline between the wellhead and the facility, passing the output production flow through a sand management system installed in the pipeline, wherein the sand management system comprises a solids separator configured to separate sand from the oil of the output production flow, wherein the sand management system has an input which receives the output production flow from the wellhead along an upstream part of the pipeline, the upstream part being upstream of the sand management system, and an oil output which outputs the oil, having sand separated therefrom, along a downstream part of the pipeline, the downstream part being downstream of the sand management system;

(c) opening a choke of the wellhead to increase the oil production rate and sand production rate, whereby the sand production rate is increased to a level higher than a value of an allowable sand rate (ASR) which is a predetermined maximum threshold sand production rate of the pipeline, and, at least during a time period when the sand production rate is higher than the allowable sand rate (ASR), continuously or continually separating sand in the output production flow from the oil of the output production flow using the solids separator of the sand management system to provide a zero or non-zero reduced sand flow in the downstream part of the pipeline;

(d) after or during step c), measuring sand flow in at least one of the sand management system or the downstream part of the pipeline to provide a value of a reduced sand flow rate, which is a flow rate of the reduced sand flow in the downstream part of the pipeline;

(e) comparing the value of the reduced sand flow rate with the value of the allowable sand rate (ASR) to provide a sand rate comparison value; and (f) controlling the oil production rate using the sand rate comparison value to maintain the reduced sand flow rate in the downstream part of the pipeline below the allowable sand rate (ASR);

wherein the sand management system is temporarily installed in the pipeline for a series of intermittent time periods, each intermittent time period comprising a test period during which the sand management system is operational to separate sand from the oil production, and the sequence of the combination of steps b), c), d), e) and f) is carried out during the test period, and wherein the method further comprises the steps, after step c) and during the test period, of (I) closing the choke of the wellhead to decrease the oil production rate and sand production rate; (II) measuring the decreased reduced sand flow rate in the pipeline to provide a measured decreased reduced sand flow rate, (III) comparing the measured decreased reduced sand flow rate and the allowable sand rate (ASR) to determine the sand rate comparison value to confirm that the measured decreased reduced sand flow rate is no greater than the allowable sand rate (ASR); (IV) setting the oil production rate to a set production rate corresponding to the decreased oil production rate; and (V) terminating the test period.

2. A method according to claim 1 wherein the sand rate comparison value comprises, or is, a sand rate control parameter which is used to control the sand rate in the controlling step (f).

3. A method according to claim 1 wherein in step (e) the reduced sand flow rate and the allowable sand rate (ASR) are compared to determine the sand rate comparison value and to confirm that the measured reduced sand flow rate is below the allowable sand rate (ASR), and in step (f) the oil production rate is controlled using the sand rate comparison value by controlling the choke to set the oil production rate to a set production rate corresponding to the oil production rate in step (c).

4. A method according to claim 1 wherein in step c) the oil production rate is increased to a value so that the associated sand flow rate from the reservoir is no greater than a predetermined maximum threshold, which maximum threshold has been determined or estimated to avoid damage to the wellbore and/or wellhead upstream of the sand management system and/or damage to the reservoir.

5. A method according to claim 1 further comprising the steps, before step c), of (i) measuring the sand production rate in the pipeline to provide a measured sand production rate from the reservoir, (ii) determining or estimating a maximum accumulated sand flow rate of sand at least partially resulting from the removal of accumulated sand from the wellbore, and (iii) calculating from the measured sand production rate and the maximum accumulated sand flow rate, and from a maximum sand separation rate of the sand management system, a first maximum oil production rate of oil to be conveyed to the sand management system to maintain a sand flow rate below the allowable sand rate (ASR) at the output of the sand management system, whereby excess sand above the allowable sand rate (ASR) is separated from the oil by the solids separator, and wherein in step c) the oil production rate is increased to a level no greater than the calculated first maximum oil production rate.

6. A method according to claim 1 wherein after the commencement of step c), the oil production rate and the sand production rate are permitted, after an initial increase in sand flow rate at least partially resulting from the removal of accumulated sand from the wellbore, to stabilise to respective stabilised values of the oil and sand production rates exiting the reservoir of the oil well.

7. A method according to claim 1 wherein the choke is closed in step (I) after the oil production rate and the sand production rate have stabilised, subsequent to an initial increase in sand flow rate at the commencement of step c) at least partially resulting from the removal of accumulated sand from the wellbore, to respective stabilised values of the oil and sand production rates exiting the reservoir of the oil well.

8. A method according to claim 1 further comprising the step, after terminating the test period in step (V), of step (VI) which comprises uninstalling the sand management system from the pipeline at the end of the test period.

9. A method according to claim 8 wherein, subsequent to step (VI), after a production time period during which continuous output production flow is conveyed by the pipeline from the wellhead to the facility for processing, transporting by pipeline, or storing the oil, the sand management system is re-installed on the pipeline and steps b) to f) are repeated.

10. A method according to claim 9 wherein the production time period is at least one week or at least one month.

11. A method according to claim 1 wherein the input of the sand management system continuously receives the output production flow from the wellhead and the oil output of the sand management system continuously or continually outputs the oil, having sand separated therefrom, along the downstream part of the pipeline.

12. A method according to claim 1 wherein the sand management system carries out the following steps:

A. separating sand from the hydrocarbon-containing oil using the solids separator and independently outputting from the solids separator the sand and a remaining hydrocarbon-containing oil; and B. cleaning residual oil deposits from the sand separated by the solids separator in a solids cleaning system connected to a solids output of the solids separator, the solids cleaning system having a first output outputting the cleaned sand and a second output outputting first residual oil.

13. A method according to claim 12 wherein the hydrocarbon-containing oil and the sand are present in a multiphase hydrocarbon-containing fluid comprising an oil phase, a sand phase, a water phase and a gas phase, and wherein the sand management system carries out the following further steps:

C. after separating sand from the hydrocarbon-containing oil using the solids separator, separating the remaining multiphase hydrocarbon-containing oil into an oil phase, a water phase and a gas phase in a fluid separator in fluid communication with the solids separator;

D. independently removing the oil phase, the gas phase and the water phase from the fluid separator, wherein the oil phase is removed from the separation system through an oil outlet, the gas phase is removed from the separation system through a gas outlet; and the water phase is removed from the separation system through a water outlet; and E. cleaning residual oil from the water phase separated by the fluid separator by a water cleaning and recycling system connected to the water outlet of the fluid separator, wherein the water cleaning and recycling system comprises an oil separator separating oil from the water phase to provide cleaned water and second residual oil, the oil separator outputting the cleaned water, and outputting the second residual oil.

14. A method according to claim 13 wherein the first and/or second residual oil are recycled to the sand management system or to the pipeline, or wherein the first residual oil is recycled to the fluid separator and/or the second residual oil is recycled to the fluid separator.

15. A method according to claim 14 wherein the oil separator separates oil from the water phase whereby the oil content of the cleaned water is within the range of from 5 to 20 ppm by weight, based on the total weight of the cleaned water.

16. A method according to claim 14 wherein the fluid separator removes oil from the water phase whereby the oil content of the water phase exiting the fluid separator is within the range of from 300 to 500 ppm by weight, based on the total weight of the water phase.

17. A method according to claim 13 wherein (I) the solids separator removes sand from the multiphase hydrocarbon-containing fluid whereby the sand content of the remaining multiphase hydrocarbon-containing fluid entering the fluid separator is within the range of from 0.5 to 1 weight %, based on the total weight of the remaining multiphase hydrocarbon-containing fluid, and/or (II) the fluid separator removes water from the oil phase whereby the water content of the oil phase exiting the oil outlet is within the range of from 1 to 2 weight %, based on the total weight of the oil phase, and/or (III) the solids separator removes sand from the multiphase hydrocarbon-containing fluid whereby the hydrocarbon content of the sand exiting the solids outlet is within the range of from 5 to 10 weight %, based on the total weight of the separated sand.

* * * * *